US008191946B1

(12) United States Patent
McCary

(10) Patent No.: US 8,191,946 B1
(45) Date of Patent: Jun. 5, 2012

(54) GOLF UTILITY DEVICES

(76) Inventor: Rocky Dean McCary, Euless, TX (US)

( * ) Notice: Subject to any disclaimer, the term of this patent is extended or adjusted under 35 U.S.C. 154(b) by 0 days.

(21) Appl. No.: 13/069,246

(22) Filed: Mar. 22, 2011

(51) Int. Cl.
*A63B 47/02* (2006.01)

(52) U.S. Cl. ..... 294/19.2

(58) Field of Classification Search ..... 294/1.3, 294/1.4, 1.5, 19.2, 209, 210, 104, 50.9; 473/386; 119/161
See application file for complete search history.

(56) References Cited

U.S. PATENT DOCUMENTS

| | | | | |
|---|---|---|---|---|
| 4,248,430 | A | 2/1981 | Kepler | |
| 4,787,632 | A | 11/1988 | Nigrelli et al. | |
| 5,205,598 | A | 4/1993 | Miller | |
| 5,310,177 | A | 5/1994 | Conrad et al. | |
| 5,423,543 | A | 6/1995 | Tarrant | |
| 6,254,497 | B1 | 7/2001 | Brant et al. | |
| 6,716,118 | B1 | 4/2004 | Asta | |
| 6,843,737 | B1 | 1/2005 | Smith et al. | |
| 7,059,971 | B1 | 6/2006 | Schmitt | |
| 7,559,848 | B2 | 7/2009 | Nickel | |
| 7,695,035 | B2 * | 4/2010 | Sumner et al. | 294/1.4 |

* cited by examiner

*Primary Examiner* — Paul T Chin
(74) *Attorney, Agent, or Firm* — Afghani Law Firm; Kevin Afghani

(57) ABSTRACT

Golf utility devices are provided. In one embodiment, a golf utility device includes a rod having a first end and a second end, and a grasping portion coupled to the first end of the rod. The grasping portion includes a first grasping arm including a first enlarged tip, and a second grasping arm including a second enlarged tip. The second grasping arm is pivotably coupled to the first grasping arm. The first and second grasping arms are movable into a closed position and an open position. The golf utility device also includes a handle portion coupled to the second end of the rod. The handle portion includes a handle and a trigger movable into a plurality of positions including a released position and an activated position. The first and second grasping arms are adapted to move into the closed position when the trigger is moved into the activated position.

20 Claims, 4 Drawing Sheets

GOLF UTILITY DEVICES

TECHNICAL FIELD

The illustrative embodiments relate generally to utility devices, and more particularly, to improved golf utility devices.

BACKGROUND

The sport of golf requires a player to perform many tasks. Some of these tasks may involve the act of bending down, such as repairing divots or picking up or setting down a golf ball, golf club, flag, ball marker, or other object. Current golf-related devices fail to conveniently or reliably reduce the amount of bending required of a player while playing golf. In some cases, these current systems may also fail to conveniently assist in the varied tasks that require a golf player to bend down.

SUMMARY

According to an illustrative embodiment, a golf utility device includes a rod having a first end and a second end, and a grasping portion coupled to the first end of the rod. The grasping portion includes a first grasping arm including a first enlarged tip, and a second grasping arm including a second enlarged tip. The second grasping arm is pivotably coupled to the first grasping arm. The first and second grasping arms are movable into a plurality of positions relative to one another. The plurality of positions includes a closed position and an open position. The golf utility device also includes a handle portion coupled to the second end of the rod. The handle portion includes a handle and a trigger movable into a plurality of positions including a released position and an activated position. The first and second grasping arms are adapted to move into the closed position when the trigger is moved into the activated position.

According to another illustrative embodiment, a golf utility device includes a grasping portion. The grasping portion includes a first grasping arm having a distal end including a first base protrusion. The first base protrusion forms a substantially flat ground-contactable surface. The grasping portion also includes a second grasping arm having a distal end including a second base protrusion. The second base protrusion forms a substantially flat ground-contactable surface. The second grasping arm is pivotably coupled to the first grasping arm. The first and second grasping arms are movable into a plurality of positions comprising a closed position and an open position. The grasping portion also includes a ball marker slit at least partially disposed in at least one of the first or second base protrusions. The ball marker slit is substantially parallel to the ground when the ground-contactable surfaces are adjacent the ground. The ball marker slit is adapted to receive at least a portion of a ball marker. The golf utility device also includes a handle portion coupled to the grasping portion via a rod. The handle portion includes a trigger movable into a plurality of positions comprising a released position and an activated position. The first and second grasping arms are adapted to move into the closed position when the trigger is moved into the activated position. The first and second base protrusions are operable to grasp onto at least the edges of the ball marker when the first and second grasping arms are in the closed position such that at least a portion of the ball marker is received by the ball marker slit.

According to another illustrative embodiment, a golf utility device includes a grasping portion. The grasping portion includes a first grasping arm including a first enlarged tip, and a second grasping arm including a second enlarged tip. The second grasping arm is pivotably coupled to the first grasping arm. The first and second grasping arms are movable into a plurality of positions including a closed position and an open position. The golf utility device also includes a handle portion coupled to the grasping portion via a rod. The handle portion includes a handle and a trigger movable into a plurality of positions including a released position and an activated position. The handle portion also includes a divot tool including a pronged portion. The divot tool is adapted to be maneuvered by a user using the grasping portion of the golf utility device. The first and second grasping arms are adapted to move into the closed position when the trigger is moved into the activated position.

DETAILED DESCRIPTION

Figure 1:
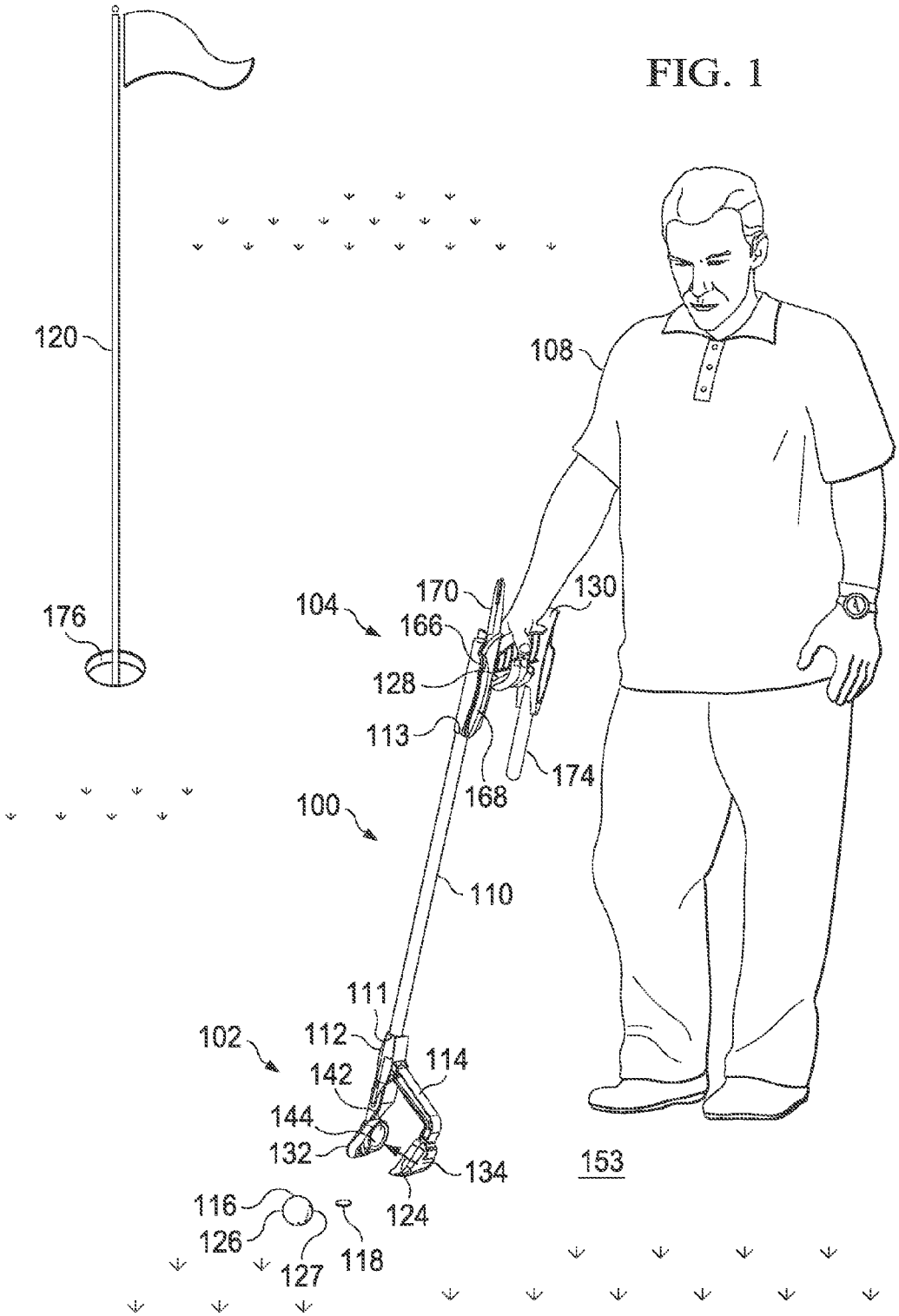
FIG. 1 is a schematic, pictorial representation of a golf utility device being used on a golf course according to an illustrative embodiment.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in limiting sense, and the scope of the illustrative embodiments are defined only by the appended claims.

Referring to FIGS. 1 through 5, an illustrative embodiment of a golf utility device 100 includes a grasping portion 102, which may be used to, among other things, grasp onto an object, and a handle portion 104, which includes a handle 106 for a user 108. The grasping portion 102 may be coupled to the handle portion 104 by a rod 110 such that the grasping portion 102 is coupled to a first end 111 of the rod 110 and the handle portion 104 is coupled to a second end 113 of the rod 110. The rod 110 may be any length, including an adjustable length, and have any lateral cross-sectional shape (e.g., circular, square, rectangular, triangular, etc.).

As used herein, the term "coupled" includes coupling via a separate object and includes direct coupling. The term "coupled" also encompasses two or more components that are continuous with one another by virtue of each of the components being formed from the same piece of material. Also, the term "coupled" may include chemical, such as via a chemical bond, mechanical, thermal, magnetic, or electrical coupling. Unless otherwise indicated, as used herein, "or" does not require mutual exclusivity.

In one embodiment, the grasping portion 102 of the golf utility device 100 includes a first grasping arm 112 and a second grasping arm 114 that may be used to grasp onto an object, such as a golf ball 116, a golf club (not shown), a flag 120, a ball marker 118 (e.g., metal ball marker, plastic ball marker, coin, etc.), or any other object. In one embodiment, the first grasping arm 112 may be substantially stationary relative to or coextensive with the rod 110. The second grasping arm 114 may be pivotably coupled, such as via a pivot joint 122, to the first grasping arm 112 to allow the second grasping arm 114 to move towards and away from the first grasping arm 112.

The first and second grasping arms 112, 114 are shown to be in an open position in FIGS. 1 through 4. The second grasping arm 114 may move toward the first grasping arm 112 along arrow 124 so that the first and second grasping arms 112, 114 are in a closed position. When in the closed position, the first and second grasping arms 112, 114, and in particular the distal ends 136, 138 of the first and second grasping arms 112, 114, may be closer to one another than in the open position so as to grasp onto an object between the first and second grasping arms 112, 114. It will be appreciated that the first and second grasping arms 112, 114 may be considered to be in the closed position when the second grasping arm 114 has been moved toward the first grasping arm 112, regardless of whether an object is present between the grasping arms 112, 114.

When the first and second grasping arms 112, 114 are closed so as to grasp an object, that object may be picked up, placed somewhere, or otherwise moved or maneuvered by the user 108. In one non-limiting example, the first and second grasping arms 112, 114 may grasp onto the sides 126, 127 of the golf ball 116, allowing the user 108 to pick up or place the golf ball 116 from or onto the ground 153.

Figure 2:
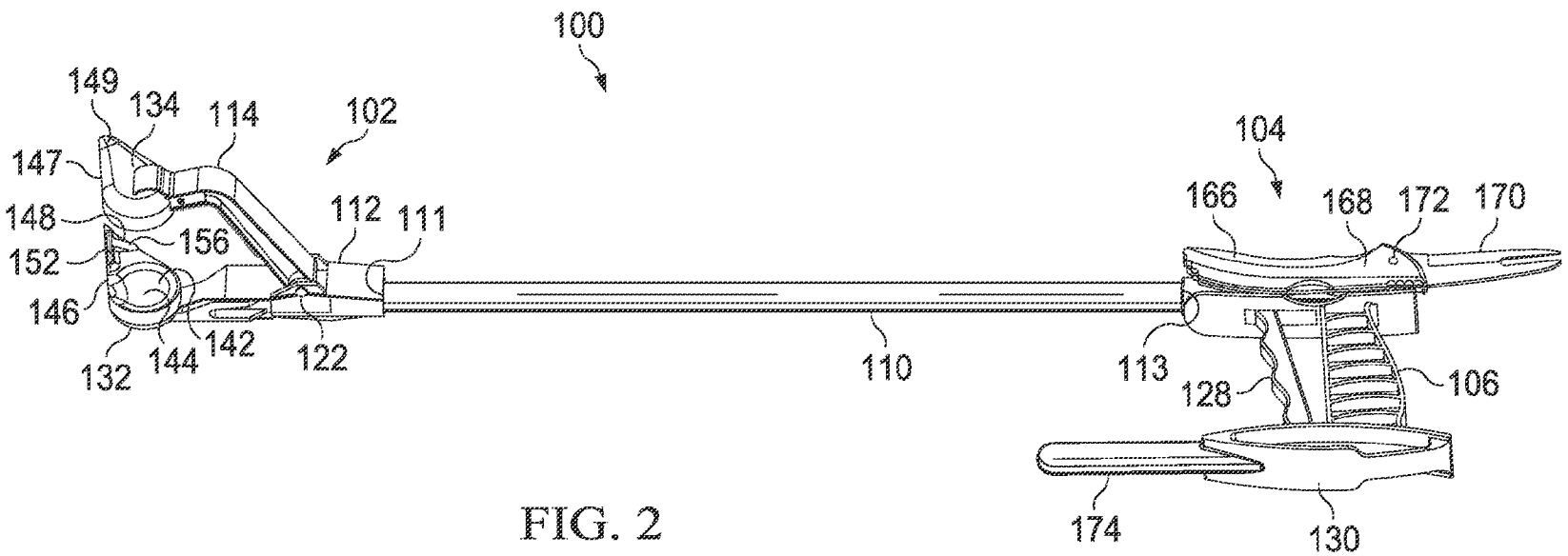
FIG. 2 is a schematic, perspective view of a golf utility device according to an illustrative embodiment.
Figure 5:
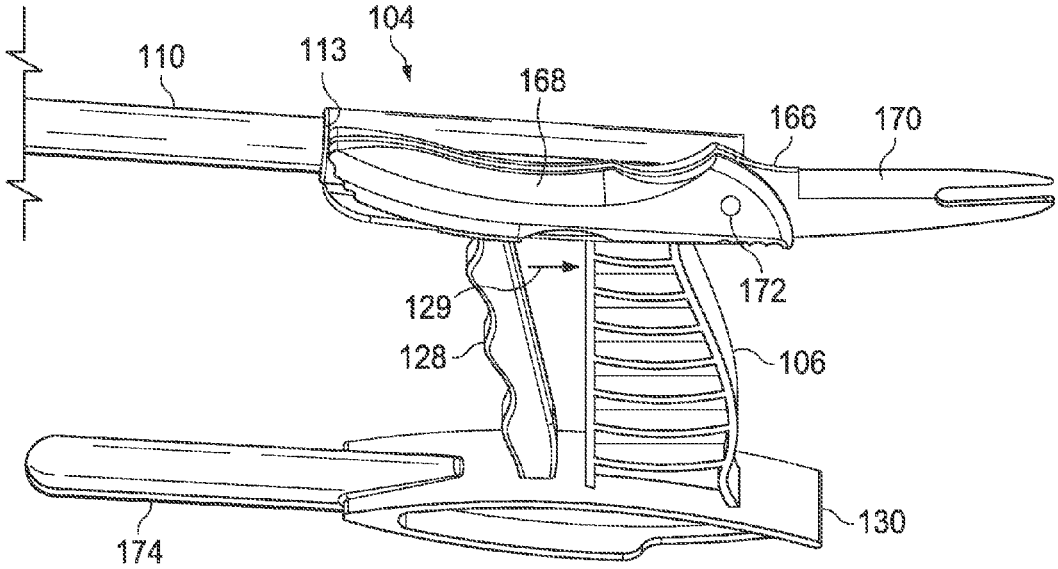
FIG. 5 is a schematic, perspective view of the handle portion of the golf utility device according to an illustrative embodiment.

In one embodiment, the first and second grasping arms 112, 114 may be moved between the open and closed positions using a trigger 128 that is movable by the user 108. The trigger 128 may be movable between a released position, which is shown in FIGS. 1, 2, and 5, and an activated position. Specifically, the user 108 may depress or pull the trigger 128 in a direction indicated by the arrow 129 using his or her hand to move the trigger 128 into the activated (depressed) position. The trigger 128 may be in the released (non-depressed) position shown in FIGS. 1, 2, and 5 when released by the user 108.

When the user 108 depresses the trigger 128, the first and second grasping arms 112, 114 may be caused to move into the closed position. Conversely, when the user 108 releases the trigger 128, the trigger 128 may move back into the released position to cause the first and second grasping arms 112, 114 to swing or move away from one another and back into the open position shown in FIGS. 1 through 4. In an alternative embodiment, the grasping arms 112, 114 may be closed when the trigger 128 is released and open when the trigger 128 is depressed.

The mechanisms by which the trigger 128 may mechanically communicate, or be mechanically coupled with, the first and second grasping arms 112, 114 are numerous. In one non-limiting embodiment, pulling the trigger 128 may pull, or otherwise activate, a wire or string (not shown) inside the rod 110 that is operable to pull, or otherwise move, the second grasping arm 114 into the closed position. In another embodiment, communication between the trigger 128 and the first and second grasping arms 112, 114 may be electronic, and pulling the trigger 128 may electronically signal or cause the first and second grasping arms 112, 114 to close.

In one embodiment, the trigger 128 may be pivotably coupled to a base 130 of the handle portion 104 to allow for movement of the trigger 128 between the released (non-depressed) and activated (depressed) positions. Also, the shape of the trigger 128, as well as the body part of the user 108 used to activate the trigger 128, may vary. For example, while the trigger 128 shown in FIGS. 1, 2, and 5 may be depressed by three or four fingers of the user's hand, in another embodiment the trigger 128 may be movable using only one or two of the user's fingers.

In the illustrative embodiment shown in FIGS. 1 to 5, pulling the trigger 128 causes the second grasping arm 114 to swing or move toward the first grasping arm 112, while the first grasping arm 112 remains relatively stationary relative to the rod 110. However, in other embodiments, both the first and second grasping arms 112, 114 may move relative to one another and the rod 110 in response to the movement of the trigger 128. Also, although the second grasping arm 114 is shown to be pivotably coupled to the first grasping arm 112, in other embodiments the second grasping arm 114 may be movably coupled to any part of the grasping portion 102, including the rod 110.

In one embodiment, the first and second grasping arms 112, 114 may each include a first and second enlarged tip 132, 134, respectively. The first and second enlarged tips 132, 134 may be located at the distal ends 136, 138 of the first and second grasping arms 112, 114, respectively. In one non-limiting example, either or both of the enlarged tips 132, 134 may have a width 139 that is larger than the width 140 of the remainder of the grasping arm 112 or 114 to which the enlarged tip 132 or 134 is coupled. The enlarged tips 132, 134 may include a number of substructures and may be used to perform a variety of tasks, non-limiting examples of which are described as follows.

The first and second enlarged tips 132, 134 may include inward-facing surfaces 142, 143, respectively, that face one another. In one embodiment, the inward-facing surface 142 of the first enlarged tip 132 may include a curved depression, or indent, 144. Similarly, the inward-facing surface 143 of the second enlarged tip 134 may also include a curved depression 145. All or a portion of the curved depressions 144, 145 may have a curved surface.

Figure 3:
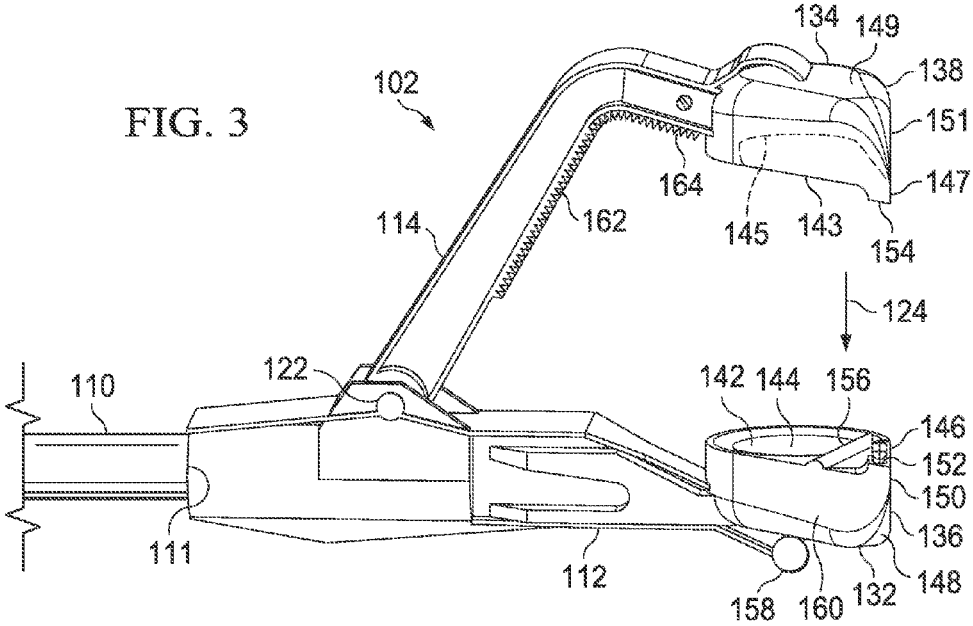
FIG. 3 is a schematic, plan view of the grasping portion of a golf utility device according to an illustrative embodiment.
Figure 4:
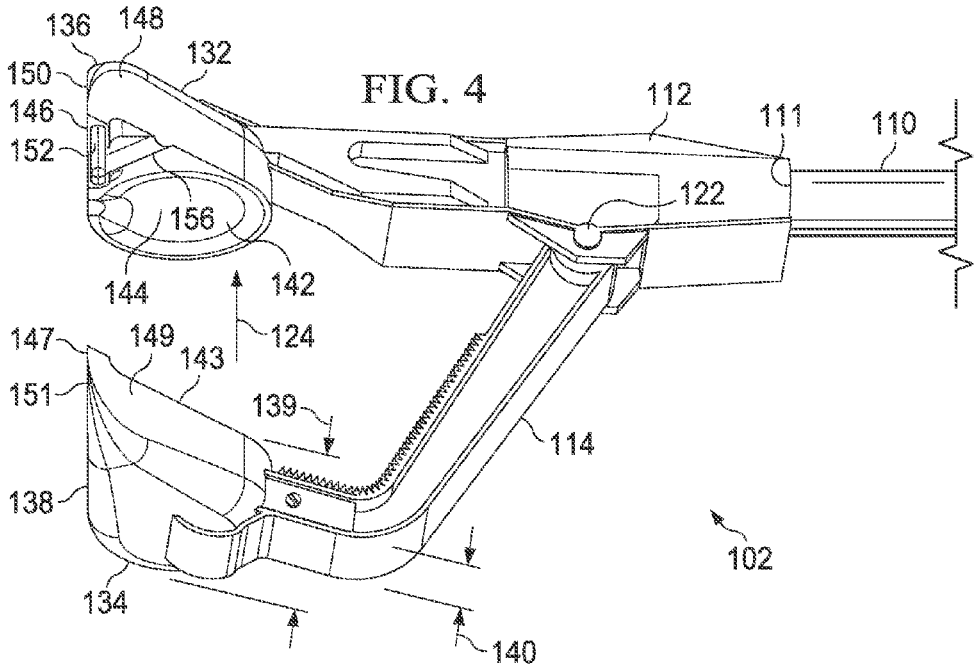
FIG. 4 is a schematic, perspective view of the grasping portion of the golf utility device according to an illustrative embodiment.

The curved depressions 144, 145 may cover any surface area of the inward-facing surfaces 142, 143 of the first and second enlarged tips 132, 134, respectively. In one illustrative embodiment, the first and second enlarged tips 132, 134 may include substantially flat ground-contactable surfaces 146, 147, respectively. The ground-contactable surfaces 146, 147 may be shaped, or otherwise adapted, to come into contact with the ground 153. As shown in FIGS. 3 and 4, the curved depressions 144, 145 may extend all the way to the ground-contactable surfaces 146, 147 for the first and second enlarged tips 132, 134, respectively. In another embodiment, the curved depressions 144, 145 may approximate a circular, or semi-spherical, indentation shape. In embodiment, the curved depressions 144, 145 may be shaped to at least partially contour the golf ball 116 to help provide a firmer or more stable grip onto the sides 126, 127 of the golf ball 116 when the first and second grasping arms 112, 114 are in the closed position.

Either or both of the first and second enlarged tips 132, 134 may include a base protrusion 148, 149, respectively. In one embodiment, a portion 150, 151 of the base protrusions 148, 149 may be substantially flat and form part of the ground-contactable surfaces 146, 147 of the first and second enlarged tips 132, 134, respectively.

In one embodiment, either or both of the first and second enlarged tips 132, 134 may include a ball marker slit 152. The ball marker slit 152 may be shaped to receive or hold at least a portion of the ball marker 118, such as an edge of the ball marker 118. The ball marker slit 152 may also be shaped to contour the edge of the ball marker 118 to provide a secure fit. The ball marker slit 152 may be oriented substantially parallel to the ground 153 when the ground-contactable surfaces 146, 147 of the first and second enlarged tips 132, 134 are adjacent or abutting the ground 153. Also, the ball marker slit 152 may be fully or partially located on one of the base protrusion 148, 149 of the first or second enlarged tips 132, 134. The ball marker slit 152 may also be included in an embodiment that lacks base protrusions 148, 149 such that the ball marker slit 152 is fully disposed on one of the first or second enlarged tips 132, 134.

The ball marker slit 152 may be used to facilitate grasping of the ball marker 118 by the first and second grasping arms 112, 114. For example, if the user 108 desires to place the ball marker 118 onto the ground 153, the user 108 may place the ball marker 118 into the ball marker slit 152 and squeeze the trigger 128 to cause the first and second grasping arms 112, 114 to close and grasp upon the edges of the ball marker 118; when grasped by the first and second grasping arms 112, 114, at least a portion of the ball marker 118 may be received inside the ball marker slit 152. The user 108 may then position the ball marker 118 onto the ground 153 and release the trigger 128 so that the ball marker 118 falls onto the ground 153 at a desired location. Conversely, the user 108 may pick up the ball marker 118 from the ground 153 by grasping onto the edges of the ball marker 118 using the first and second grasping arms 112, 114.

In one embodiment, the first or second enlarged tips 132, 134 may include one or more protrusions that facilitate grasping of the ball marker 118. In one embodiment, either or both of the first or second enlarged tips 132, 134 or the first or second base protrusions 148, 149 may include an inward-facing support protrusion 154. The support protrusion may be oriented so as to be substantially parallel to the ground 153 when the ground-contactable surfaces 146, 147 of the first and second enlarged tips 132, 134 are adjacent or abutting the ground. 153. The support protrusion 154 may help to retain the ball marker 118 in the ball marker slit 152 when the first and second grasping arms 112, 114 are closed and grasping onto the ball marker 118. The support protrusion 154 may also be tapered to help lift the ball marker 118 off the ground 153 and into the ball marker slit 152 when the golf utility device 100 is used to grasp the ball marker 118 from off the ground 153. The support protrusion 154 may also help provide an opposing force from the second grasping arm 114 to counterbalance the force exerted onto the ball marker 118 by the ball marker slit 152 of the first grasping arm 112.

In one embodiment, either or both of the first or second enlarged tips 132, 134 may include an inward-facing guide protrusion 156. In one example, the guide protrusion 156 may approximate a triangular shape and be located adjacent, or just above, the ball marker slit 152. In one embodiment, the guide protrusion 156 may help to guide the ball marker 118 into the ball marker slit 152 when the first and second grasping arms 112, 114 are moved into the closed position to grasp onto the ball marker 118. The guide protrusion 156 may also help to provide a more stable grip on the ball marker 118.

In one embodiment, either or both of the first or second enlarged tips 132, 134 may include a magnet 158 that is operable to attract a metal ball marker, such as the ball marker 118, when the magnet 158 is placed in proximity to the ball marker 118. By attracting a proximate ball marker 118, the magnet 158 may be used to pick up the ball marker 118 from the ground. In one illustrative embodiment, the grasping portion 102 may be used to pick up the ball marker 118 by either grasping onto the ball marker 118 using the ball marker slit 152, as described above, or by attracting the ball marker 118 using the magnet 158.

The magnet 158 may be coupled to any portion of the grasping portion 102 of the golf utility device 100. Indeed, the magnet 158 may be coupled to any portion of the golf utility device 100. In the non-limiting example of FIG. 3, the magnet 158 is coupled to an outward-facing surface 160 of the first enlarged tip 132.

The magnet 158, while shown to be cylindrical, may be any shape that allows for the attraction of the ball marker 118. Also, the golf utility device 100 may include any number of magnets.

In one embodiment, the second grasping arm 114 may include an inward-facing surface 162 on which a plurality of ridges 164 are disposed. The ridges 164 may help to provide friction to facilitate the grasping of an object by the first and second grasping arms 112, 114. For example, the first and second grasping arms 112, 114 may be closed upon an object, such as a golf club or flag 120, such that the ridges 164 grip against the object to provide a firmer grasp. The use of the ridges 164 to grasp objects also illustrates that the golf utility device 100 is not limited to grasping objects only with the first and second enlarged tips 132, 134. Although the ridges 164 are shown to be coupled to the second grasping arm 114, either or both of the first or second grasping arms 112, 114 may have ridges 164 disposed thereon. Also, the ridges 164 may be formed from any material (e.g., plastic, rubber, metal, etc.), and may be the same as or different than the material forming the first and second grasping arms 112, 114.

In one embodiment, the handle portion 104 of the golf utility device 100 may include a divot tool 166. The divot tool 166 may be used by the user 108 to repair divots in the ground 153, such as divots created by a golf club or the golf ball 116 upon impact with the ground 153. The divot tool 166 may include a sheath portion 168 and a pronged portion 170. In one embodiment, the pronged portion 170 may be retractable into the sheath portion 168 of the divot tool 166, such as via a pivot joint 172.

In another embodiment, the divot tool 166 includes a non-retractable pronged portion 170. In yet another embodiment, the divot tool 166 may be detachable from the handle portion 104 for use separate from the golf utility device 100.

When the pronged portion 170 is extended, as shown in FIGS. 1, 2, and 5, the user 108 may maneuver the divot tool 166 by holding onto the grasping portion 102 or rod 110 of the golf utility device 100, as opposed to the handle portion 104. Using his or her hold upon the grasping portion 102, the user 108 may maneuver the divot tool 166 so as to repair divots or perform any other function suitable for the divot tool 166. In one embodiment, the pronged portion 170 may be inserted into the ground 153 so as to support the golf utility device 100 in a standing position. In the standing position, the golf utility device 100 may be vertical relative to the ground 153. By standing the golf utility device 100 in this manner, the user 108 may be prevented from having to bend down to pick up or place the golf utility device 100 from or on the ground 153, respectively. In one non-limiting example, the golf utility device 100 may be placed in the standing, or vertical, position while the user 108 putts the golf ball 116.

In another embodiment, the handle portion 104 of the golf utility device 100 may include a hanging arm 174. The hanging arm 174 may engage with another object and be used to hang the golf utility device 100. In one non-limiting example, the hanging arm 174 may be inserted into a strap, a hook, or the open end of a bag, such as a golf bag, so that the golf utility device 100 may be conveniently hung from the bag to ease transport of the golf utility device 100. The hanging arm 174 may have any shape suitable for allowing the golf utility device 100 to be hung.

In operation, the user 108 may use the golf utility device 100 in a variety of ways during a game of golf. For example, after the user 108 takes a shot, the user 108 may place a metal ball marker 118 into the ball marker slit 152 and squeeze the trigger 128 to grasp the ball marker 118, and then place the ball marker 118 on the ground 153 behind the spot where the golf ball 116 has landed. After placing the ball marker 118, the user 108 may then proceed to pick up his or her golf ball 116 from the ground 153 by squeezing the trigger 128 to grasp onto the golf ball 116 using the first and second enlarged tips 132, 134. When it is the user's 108 turn to take a shot, the user 108 may grasp his or her golf ball 116 with the first and second enlarged tips 132, 134 and place the golf ball 116 back in front of the ball marker 118. The user 108 may then use the magnet 158 to attract the ball marker 118 and pick the ball marker 118 off the ground 153.

The user 108 may also use the golf utility device 100 to remove the flag 120 from the hole 176 or the ground 153. The golf utility device 100 may also be used to grasp onto the golf ball 116 to retrieve it from out of the hole 176 after a successful shot. At times, golf clubs, including wedges, may need to be picked up from the ground 153; the golf utility device 100 may be used to grasp onto and pick up golf clubs on the ground 153, such as by using the ridges 164 described above.

If a golf club or the golf ball 116 makes an indent in the ground 153, the user 108 may extend the divot tool 166 to expose the pronged portion 170. The user 108 may then hold the grasping portion 102 or the rod 110 of the golf utility device 100, and maneuver the divot tool 166 to repair the indent made by the golf club or golf ball 116. When the golf utility device 100 needs to be set aside by the use 108, the user 108 may submerge the pronged portion 170 of the divot tool 166 into the ground 153 so as to support the golf utility device 100 in a standing or vertical position, thereby preventing the user 108 from having to bend down to place or pick up the golf utility device 100. As illustrated by these non-limiting examples, the golf utility device 100 may prevent or reduce bending by the user 108 during golf.

As used herein, including in the claims, the terms first, second, third, etc. . . . used in relation to an element (e.g., first grasping arm, second grasping arm, etc.) are for reference or identification purposes only, and these terms, unless otherwise indicated, are not intended to describe or suggest a number, order, source, purpose, or substantive quality for any element for which such a term is used.

Although the illustrative embodiments described herein have been disclosed in the context of certain illustrative, non-limiting embodiments, it should be understood that various changes, substitutions, permutations, and alterations can be made without departing from the scope of the invention as defined by the appended claims. It will be appreciated that any feature that is described in a connection to any one embodiment may also be applicable to any other embodiment.

What is claimed is:

1. A golf utility device comprising:

a rod having a first end and a second end;

a grasping portion coupled to the first end of the rod, the grasping portion comprising:

a first grasping arm comprising a first enlarged tip; and a second grasping arm comprising a second enlarged tip, the second grasping arm pivotably coupled to the first grasping arm, the first and second grasping arms movable into a plurality of positions relative to one another, the plurality of positions comprising a closed position and an open position; and a handle portion coupled to the second end of the rod, the handle portion comprising:

a handle; and a trigger movable into a plurality of positions comprising a released position and an activated position;

wherein the first and second grasping arms are adapted to move into the closed position when the trigger is moved into the activated position;

wherein the first enlarged tip of the first grasping arm comprises an inward-facing surface comprising an at least partially curved depression;

wherein the second enlarged tip of the second grasping arm comprises an inward-facing surface comprising an at least partially curved depression; and wherein the curved depressions of the inward-facing surfaces of the first and second enlarged tips are shaped to at least partially contour a golf ball.

2. The golf utility device of claim 1, wherein the first and second enlarged tips are operable to grasp onto the sides of a golf ball when the first and second grasping arms are in the closed position.

3. The golf utility device of claim 1, wherein the first enlarged tip comprises a substantially flat ground-contactable surface adapted to contact the ground, the curved depression of the first enlarged tip extending to the ground-contactable surface of the first enlarged tip; and wherein the second enlarged tip comprises a substantially flat ground-contactable surface adapted to contact the ground, the curved depression of the second enlarged tip extending to the ground-contactable surface of the second enlarged tip.

4. The golf utility device of claim 1, wherein each of the first and second grasping arms comprise an inward-facing surface; and wherein the inward-facing surface of at least one of the first or second grasping arms comprise a plurality of ridges.

5. The golf utility device of claim 1, wherein at least one of the first or second enlarged tips comprises a substantially flat ground-contactable surface; and wherein the at least one of the first or second enlarged tips comprises a base protrusion, at least a portion of the base protrusion forming part of the ground-contactable surface.

6. The golf utility device of claim 1, wherein at least one of the first or second enlarged tips comprises:

a ball marker slit adapted to receive at least a portion of a ball marker, wherein the ball marker is graspable between the first and second enlarged tips such that the ball marker is partially disposed within the ball marker slit when the first and second grasping arms are in the closed position.

7. The golf utility device of claim 1, further comprising:

a magnet coupled to one of the first or second grasping arms, the magnet operable to attract a metal ball marker when the magnet is placed in proximity to the ball marker.

8. The golf utility device of claim 7, wherein each of the first and second enlarged tips comprise an outward-facing surface; and wherein the magnet is coupled to the outward-facing surface of one of the first or second enlarged tips.

9. The golf utility device of claim 1, wherein the handle portion further comprises a divot tool.

10. The golf utility device of claim 9, wherein the divot tool comprises a sheath portion and a pronged portion, the pronged portion retractable into the sheath portion.

11. The golf utility device of claim 9, wherein the divot tool comprises a pronged portion insertable into the ground such that the golf utility device is supportable in a standing position when the pronged portion is inserted into the ground.

12. The golf utility device of claim 1, wherein the handle portion further comprises:

a hanging arm operable to engage with an object to hang the golf utility device.

13. The golf utility device of claim 1, wherein the first grasping arm is substantially stationary relative to the rod; and wherein the second grasping arm is movable relative to the rod and the first grasping arm, the second grasping arm moving into the closed position when the trigger is moved into the activated position.

14. A golf utility device comprising:

a rod having a first end and a second end;

a grasping portion coupled to the first end of the rod, the grasping portion comprising:

a first grasping arm comprising a first enlarged tip; and a second grasping arm comprising a second enlarged tip, the second grasping arm pivotably coupled to the first grasping arm, the first and second grasping arms movable into a plurality of positions relative to one another, the plurality of positions comprising a closed position and an open position; and a handle portion coupled to the second end of the rod, the handle portion comprising:

a handle; and a trigger movable into a plurality of positions comprising a released position and an activated position;

wherein the first and second grasping arms are adapted to move into the closed position when the trigger is moved into the activated position;

wherein the trigger is depressible by a user; and wherein the activated position of the trigger is a depressed position relative to the handle and the released position of the trigger is a non-depressed position relative to the handle.

15. The golf utility device of claim 14, wherein the first and second enlarged tips are operable to grasp onto the sides of a golf ball when the first and second grasping arms are in the closed position.

16. The golf utility device of claim 14, wherein the first enlarged tip of the first grasping arm comprises an inward-facing surface comprising an at least partially curved depression; and wherein the second enlarged tip of the second grasping arm comprises an inward-facing surface comprising an at least partially curved depression.

17. A golf utility device comprising:

a grasping portion comprising:

a first grasping arm having a distal end comprising a first base protrusion, the first base protrusion forming a substantially flat ground-contactable surface;

a second grasping arm having a distal end comprising a second base protrusion, the second base protrusion forming a substantially flat ground-contactable surface, the second grasping arm pivotably coupled to the first grasping arm, the first and second grasping arms movable into a plurality of positions comprising a closed position and an open position; and a ball marker slit at least partially disposed in at least one of the first or second base protrusions, the ball marker slit substantially parallel to the ground when the ground-contactable surfaces are adjacent the ground, the ball marker slit adapted to receive at least a portion of a ball marker; and a handle portion coupled to the grasping portion via a rod, the handle portion comprising:

a trigger movable into a plurality of positions comprising a released position and an activated position;

wherein the first and second grasping arms are adapted to move into the closed position when the trigger is moved into the activated position; and wherein the first and second base protrusions are operable to grasp on at least the edges of the ball marker when the first and second grasping arms are in the closed position such that at least a portion of the ball marker is received by the ball marker slit.

18. The golf utility device of claim 17, wherein the ball marker slit is at least partially disposed in the first base protrusion, and wherein the second base protrusion comprises an inward-facing support protrusion substantially parallel to the ground when the ground-contactable surfaces are adjacent the ground.

19. The golf utility device of claim 17, wherein at least one of the first or second base protrusions comprises an inward-facing guide protrusion, the guide protrusion adapted to guide the ball marker into the ball marker slit when the first and second grasping arms are moved into the closed position.

20. A golf utility device comprising:

a grasping portion comprising:

a first grasping arm comprising a first enlarged tip; and a second grasping arm comprising a second enlarged tip, the second grasping arm pivotably coupled to the first grasping arm, the first and second grasping arms movable into a plurality of positions comprising a closed position and an open position; and a handle portion coupled to the grasping portion via a rod, the handle portion comprising:

a handle;

a trigger movable into a plurality of positions comprising a released position and an activated position; and a divot tool comprising a pronged portion, the divot tool adapted to be maneuvered by a user using at least one of the grasping portion or the rod of the golf utility device;

wherein the first and second grasping arms are adapted to move into the closed position when the trigger is moved into the activated position.

* * * * *